US005833455A

United States Patent [19]

Carr

[11] Patent Number: 5,833,455

[45] Date of Patent: Nov. 10, 1998

[54] DRY ROLL FURNACE ARRANGEMENT

[75] Inventor: Hugh B. Carr, McMurry, Pa.

[73] Assignee: Bricmont, Inc., Cannonsburg, Pa.

[21] Appl. No.: 645,838

[22] Filed: May 14, 1996

[51] Int. Cl.[6] ..... F27D 3/00; B21H 1/18

[52] U.S. Cl. ..... 432/246; 29/895; 266/103

[58] Field of Search ..... 432/59, 236, 246; 266/102, 103; 29/895

[56] References Cited

U.S. PATENT DOCUMENTS

| | | | |
|---|---|---|---|
| 2,024,024 | 12/1935 | Carpenter | 432/246 |
| 2,156,395 | 5/1939 | Klouman | 432/246 |
| 2,603,578 | 7/1952 | Ornitz | 432/246 X |
| 2,984,473 | 5/1961 | Ornitz et al. | 432/246 X |
| 3,070,362 | 12/1962 | Young et al. | 432/246 |
| 3,751,195 | 8/1973 | Snow | 432/246 X |
| 4,330,912 | 5/1982 | Harris | 29/130 |
| 5,070,587 | 12/1991 | Nakahira et al. | 29/132 |

*Primary Examiner*—Christopher Kilner
*Attorney, Agent, or Firm*—Clifford A. Poff

[57] ABSTRACT

A dry furnace roll design operates at a high temperature environment of a metal heating furnace by arranging weld metal joining a roll sleeve to roll bells at opposite ends in cavities formed in the sidewalls of the furnace. A dense filling of ceramic fiber material is held in each roll bell underlying the weld connection with the roll sleeve by discs. Ceramic fiber material is put into the cavity of the sidewall and held in place by a keeper plate. The masses of weld metal joining the roll sleeve to the roll bells are comprised of TIG weld metal formed in an inert gas. Multi-pass welding is performed while supporting the roll assembly during the welding operation at an angled relation to the horizontal. The roll is rotated in the angled relation to allow the deposition of weld metal in multiple passes and in an accurately controllable manner preferably by the use of a microprocessor to control the positioning of weld electrode. The metal of the roll body is subject to annealing solution heat treating after a predetermined time of service in the high temperature environment of the furnace. The solution annealing reverses embrittlement and restores ductility caused by aging process of the metal at the high operating temperatures.

18 Claims, 5 Drawing Sheets

DRY ROLL FURNACE ARRANGEMENT

BACKGROUND OF THE INVENTION

1. Field of the Invention

The present invention relates to a heating furnace intended for operation over extended periods of time to heat metallic workpieces to an elevated temperature sufficient to heat-treat, normalize or carry out a subsequent hot rolling operation, and, more particularly, to a roll construction allowing protection of weld areas by furnace walls; formation of the weld areas and heat treating of the roll after a predetermined period of operation in the high temperature environment to prevent embrittlement and reduced ductility.

2. Description of the Prior Art

Heating furnaces intended to operate over extended periods of time particularly continuously operating on a 24 hour basis place demands on the furnace equipment to withstand not only the elevated temperatures but also meet the requirement for non-stop operation. Such furnaces are commonly used to normalize or anneal metal strip, which can be supplied in a continuous fashion to the furnace by well known forms of equipment. For this purpose the trailing end of one strip is welded or otherwise secured to the leading end of a succeeding strip usually in coiled form. Another form of continuous operating furnace in the steel industry is found in a strip casting line where metal is continuously cast to a thin strip which can be 30 to 65 inches wide or greater and have a thickness usually between 1 inch and 4 inches. The continuously cast strip as it emerges from the caster is fed directly to a roller hearth tunnel furnace for heating the strip to a uniform temperature throughout, typically 2200° F., where upon the emerging strip from the furnace is immediately fed to a rolling mill installation to hot work the strip accomplished by a thickness reduction to a desired extent.

The strip passing through such furnace installations must be supported at regular intervals during heating which is usually carried out by driven roller members spanning the distance between furnace side walls and supported by bearings external to the furnace. A suitable drive is provided to rotate the rolls for advancing the strip through the furnace. The continuous exposure of the roll bodies to the operating temperature of the furnace brought about a need for roll designs to meet the requirement of an acceptable roll life. One such roll design is disclosed in U.S. Pat. No. 3,860,387 and includes a water cooled arbor to support a roll sleeve through the use of interleaving arcuate segments for transferring the load imposed on the roll sleeve to the arbor while minimizing the heat flow path to the arbor thereby reducing heat loss from the furnace by the water cooling of the arbor. Additional roll designs intending to minimize the heat flow from the atmosphere of the furnace to a water cooled arbor are disclosed in U.S. Pat. Nos. 5,082,047, 5,230,168 and 5,341,568 by providing spaced apart wheels having tire portions that engage the strip. The wheels have base members joined by web sections occupying a small area intended to minimize the heat flow from the tire to the base which is carried on a water cooled arbor. In these roll designs, some heat loss will always be experienced because of the water cooled nature of the arbor and in inability to prevent heat flow to the arbor.

In U.S. Pat. No. 5,388,280 there is disclosed annealing and tunnel furnace rolls that do not utilize water cooled arbors but instead comprise a tubular body provided with wear rings at spaced intervals to engage the strip. Bell-shaped members are welded to opposite ends of the body and inside the bell-shaped members there is a ceramic plug. The material comprising the rings is selected to be insoluble with the strip material to thereby minimize pick-up from the strip material. The material of the roll body is specified as NICHRON 72 selected for strength at high operating temperature whereas the ring material is a special metallurgical composition to achieve the reduced pick-up characteristics.

It is an object of the present invention to provide an improved roll construction and relationship with furnace walls to allow periods of long continued use in a high temperature environment of a heating furnace for metal strip to carry out any one of normalizing, annealing and reheating operations.

SUMMARY OF THE INVENTION

The present invention deviates from the known prior art by providing a dry furnace roll design to operate on a continuous basis at a high temperature environment of a metal heating furnace through the selection of an alloy metal such as an alloy of high nickel, chrome and, depending on the operating temperature in the furnace, also cobalt. The dry furnace roll is a weldment formed by weld areas connecting a hollow roll sleeve to roll bells at opposite ends for use in a furnace a manner to prevent weld degregation by protectively house the weld in furnace wall cavities from the high temperature environment in the furnace.

A further aspect of the present invention provides that masses of weld metal joining the roll sleeve to the roll bells are comprised of TIG weld metal formed in an inert gas. Multi pass welding is performed while supporting the roll assembly during the welding operation at an angled relation of preferably 45° to the horizontal. The roll is rotated in the angled relation to allow the deposition of weld metal in multiple passes and in an accurately controllable manner preferably by the use of a microprocessor to control the positioning of weld electrode.

A further aspect of the present invention provides that the metal of the roll body is subject to annealing solution heat treating after a predetermined time of service in the high temperature environment of the furnace. The solution annealing reverses embrittlement and restores ductility caused by aging process of the metal at the high operating temperatures.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
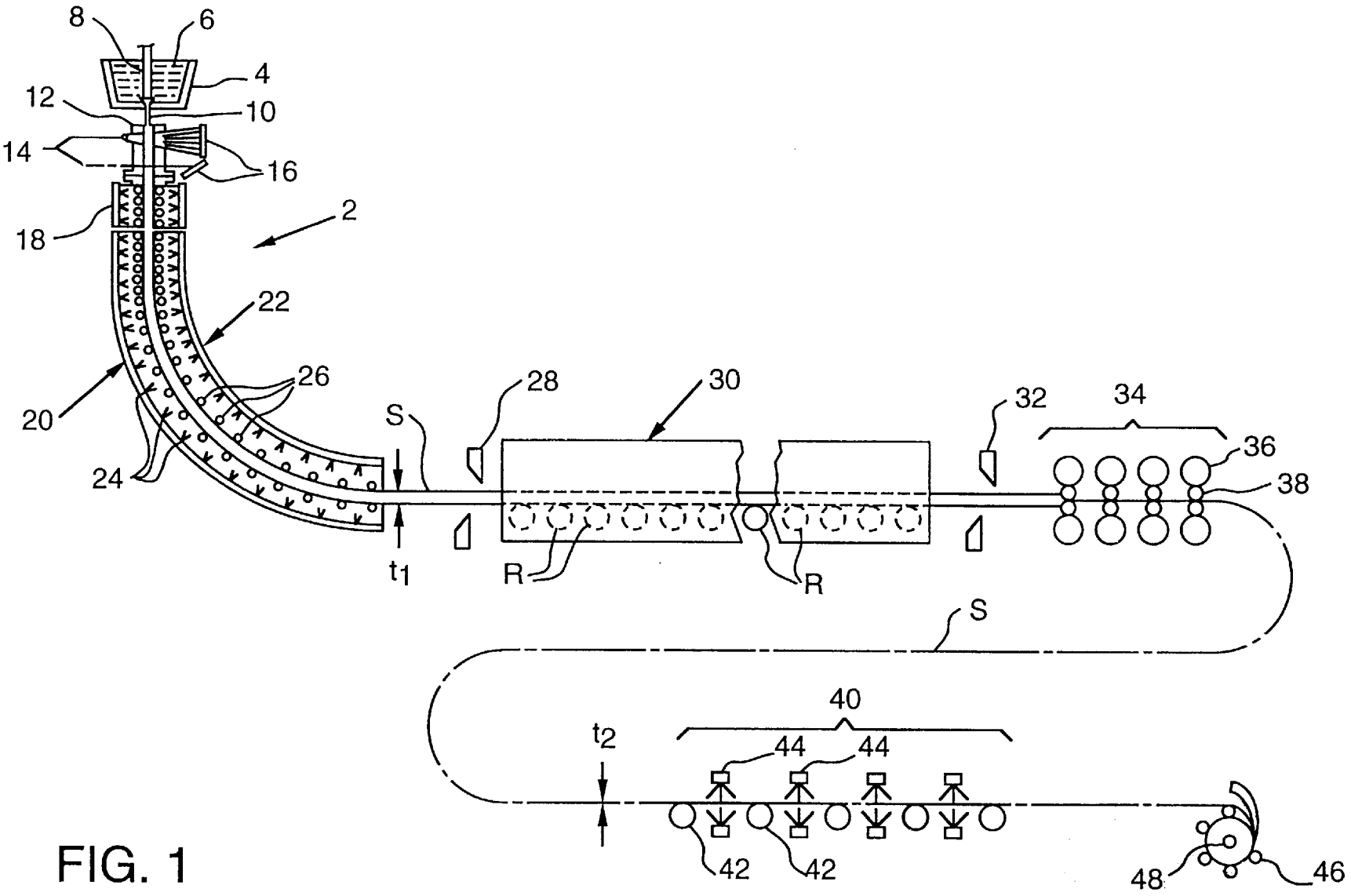
FIG. 1 is a schematic view of a continuous operating furnace for reheating a continuously cast strip product for a hot rolling operation.

In FIG. 1 there is illustrated a continuous casting machine 2 including a tundish 4 for containing a quantity of molten metal 6 and a flow control nozzle 8 for supplying molten metal from the tundish 2 into a water-cooled, oscillating mold 12. A pair of gamma ray sources 14 are positioned to one side of the oscillating mold 12 and project gamma rays through the mold 12. The gamma rays are then detected by receivers 16 which are used to provide signals indicative of the molten liquid metal level in the mold for controlling the desired level therein.

Emerging from the lower end of the mold is a cast strip that enters a straight section 18. Section 18 oscillates with a mold and contains water sprays to cool the cast strip as it passes therethrough and enters a curve cooling section 20 that also containing water sprays 24 and guide rollers 26. When the a cast strip enters the cooling section 18, there is generally a solidified skin formed by the water cooled walls of the mold. The solidified skin surrounds a general liquid core. As heat is extracted from the cast strip by cooling sections 18 and 20, the strip emerges in a generally horizontal direction with a skin temperature approximately 1200° F.–1300° F. and a core temperature of approximate 1600° F.–1800° F. given that the cast strip has thickness $t_1$ of approximately 1.5 to 4.0 inches and a width between approximately 30 to 65 inches.

The strip passes between opposing blades of a shear 28 into a roller hearth tunnel furnace 30 wherein rollers R advance the cast strip along the length of the furnace. When the strip in the furnace reaches a predetermined length, the shear 28 is operated to sever the strip in the furnace from the strip emerging from the caster. The furnace includes spaced apart sidewalls which support a roof above a hearth. Burners are suitable arranged usually in the roof to combust a gas/air mixture to maintain a highly heated environment in the furnace chamber surrounded by the walls, floor and hearth. The manner of heating the furnace chamber can be carried out by electric heaters, if desired, in a manner per se well known in the art. The furnace chamber is relatively long to provide the needed residence time for heating the strip to a predetermined desired rolling temperature. Typically, for example, the furnace may extend along a distance of at least 250 feet typically a distance of between 500 and 800 feet.

As the strip emerges from the furnace it passes between a second set of opposing shear knives of a flying shear 32 and enters the first stand of a tandem arrangement of rolling mills 34 having back up rolls 36 supporting relatively smaller diameter driven work rolls 38. Shear 32 is used to divide the strip into lengths which can be coiled without exceeding the capacity of the coiling equipment. The mill stands making up the tandem rolling mill section are per se are well known in the art. The strip is reduced to a thickness $t_2$ by the rolling mills so as to form a conventional hot band product which can be coiled after passing through a cooling section 40. The strip is supported in the cooling section by rollers 42 while sprayheads 44 direct streams of water onto the opposing surfaces of the strip. After cooling the strip enters a coiler 46 where the length of the strip is wound to form a coil for further processing. It is to be understood that such further processes of the coiled strip may include introducing the coil to an uncoiler to feed the strip into a rolling mill for cold rolling operations and, when desired, for feeding the cold rolled strip into an annealing furnace or a normalizing furnace.

The normalizing furnace is controllably heated to provide a furnace atmosphere at a temperature of approximately 1400° F. to heat the strip to a temperature of approximately 1300° F. which is sufficient to remove residual stresses in the strip. The annealing furnace is controllably heated to provide a furnace atmosphere at a temperature of approximately 1900° F. to heat the strip to a temperature of approximately 1800° F. to soften the metal of the strip from a work hardened condition usually occurring due to cold rolling operations. The normalizing furnace and annealing furnace while operating at different elevated temperatures for carrying out the desired heating of the strip, utilize rollers to support the strip and such rollers and furnaces are constructed in the same manner next to be described in regard to furnace 30.

Figure 2:
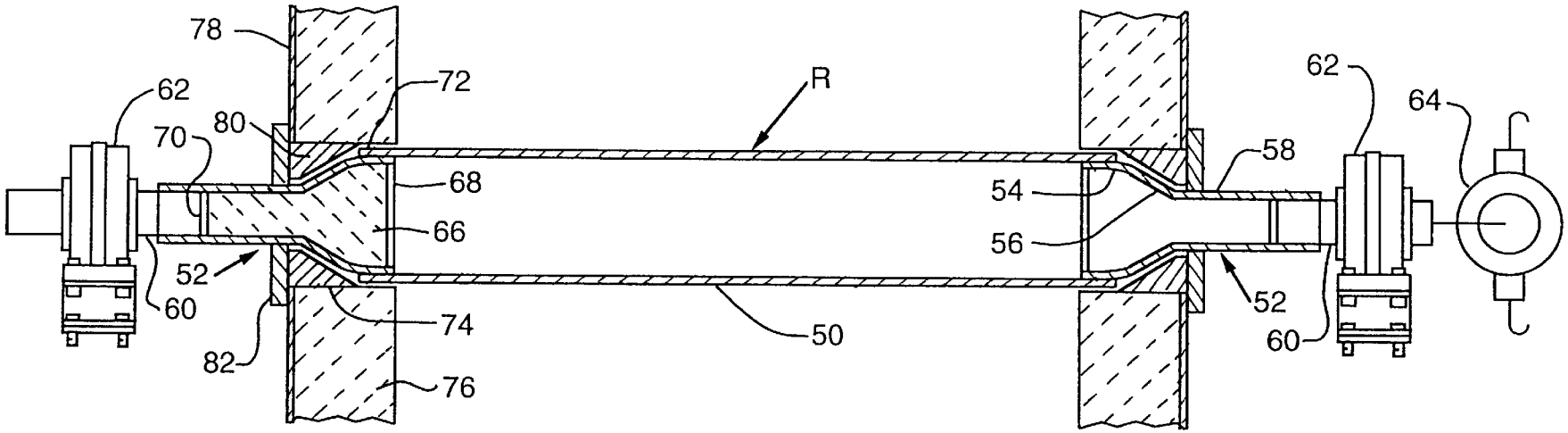
FIG. 2 is an enlarged sectional view taken along lines II—II of FIG. 1 illustrating the protective arrangement in a heating furnace for the dry roll assembly according to the present invention.

According to the present invention each of the furnace rolls R embody a construction and relationship with furnace walls as illustrated in FIG. 2. In the embodiment of the invention as shown in FIG. 2 a roll sleeve 50 is provided to advance a continuously cast metal strip in the furnace operating at temperature of, for example, 2200° F. The roll sleeve is fabricated from a spin casting of metal comprised of high nickel, chrome and cobalt alloy. The preferred alloy is 46 to 50% nickel, 26 to 30% chrome, 0.4 to 0.6% carbon, 4.0 to 6.0% tungsten, and 2.5 to 4.0% cobalt. The alloy of the roller in the normalizing furnace is 35 to 38% nickel, 25 to 28% chrome, 0.4 to 0.5% carbon, 0.5% molybdenum and 1.25 to 2.0% tungsten. In the annealing furnace the preferred alloy is 48 to 52% nickel, 32 to 34% chrome, 0.15 to 0.25% carbon, 15 to 17% tungsten, 0.75 to 1.25% aluminum and 0.5% maximum molybdenum. In each instance the same metal composition used to form the roll sleeve is also used to statically cast two roll bells 52 for each dry roll.

Each roll bell is provided with an enlarged constant diameter section 54 dimensioned to fit internally of roll sleeve 50. Section 54 extends to a truncated conical transition section 56 extending to a constant diameter sleeve section 58. The sleeve section is fitted internally with an arbor 60 rotatably supported by an anti-friction bearing assembly 62. Outwardly of the bearing assembly at one end of the roll, there is provided a suitable drive including a motor 64 for rotating the roll about the axis extending along the elongated length of the roll. A filling of ceramic fiber material 66 having a density, for example, of 6 pounds per cubic foot, is sandwiched between two alloy discs 68 and 70 to maintain the ceramic fiber material within the hollow of the bell so that the ceramic material underlies a weld area 72 joining the roll sleeve to the roll bell. The ceramic material prevents radiant heating from within the hollow of the hole sleeve 50.

The present invention provides that the weld area 72 is not exposed to the operating temperatures within the furnace. This is achieved by providing that the terminal roll body end portions including the weld areas 72 reside within aligned cavities 74 in side walls 76 of the furnace. The side walls are suitable constructed of refractory and supported by a furnace shell 78. The cavities 74 in the side walls of the furnace are preferably annular and only slightly larger in diameter than the outside diameter of the roll sleeve so as to form a gap suitable to maintain an operating clearance between the roll body and the furnace wall. A truncated conical plug 80 of ceramic fiber material is place in the annular opening in the cavities 74 to serve as a filing of heat resistant material surrounding the truncated conical portion of the roll bell. A keeper plate 82 retains the plug 80 in the furnace side wall. By this construction the flow of gaseous media is prevented from the furnace chamber along the roll bell that might otherwise detrimentally cause heating of the weld area.

A thermal analysis of this arrangement of the dry roll in a furnace has found to demonstrate by computer modeling an operation temperature of 2100° F. was assumed in the furnace chamber. The weld metal 72 attained a temperature of 1730° F. when residing at an assumed distance of 3 inches within the cavity of the furnace wall. Under these same conditions in the event the weld metal was not placed within the protective cavity of the furnace wall, the weld metal would have attained a temperature of 2080° F. when residing at a distance of one inch inward from the inside face of the furnace wall. Failure of the weld metal, at this operating temperature, will occur at a service life reduced by a factor of 5 and perhaps by a factor of 10 as compared with the service life according to the present invention.

The operating temperature of the roll bell at a site where the reduced diameter portion 52 emerges from the keeper plate 82 is 1038° F. The temperature of the roll bell and the end receiving the arbor reduces to 252° F. to allow for an operating temperature of the bearing assembly of about 211° F. given a temperature of the surrounding environment of about 100° F. The bearing assembly was assumed to operate at a distance of about 23 inches from the inside face of the furnace wall. The furnace wall thickness was 9 inches.

In the past, roll failures were found to occur when the weld metal joining the roll bell to the roll sleeve were required to operate at temperatures of about 1800° F. or greater. At this temperature threshold, the alloyed metal starts an aging process leading to premature weld failure. The aging process produces metal embrittlement and since the roll is required to support a load of the metal strip, as the roll rotates the fiber bending stress in the roll sleeve is constantly changing from compression to a tensile force which enhances metal fatigue. Moreover, stress risers occur in cast roll parts such as the roll bells where drastic changes to the section occur. The operating temperature of the roll bell is considerably reduced by placing the end portion of the roll within the cavity of the furnace wall. When not so placed, the roll bell temperature ranged from 2080° F. at the weld metal to 1020° F. where the roll bell emerged from the keeper plate. Thus, by comparison, it can be seen that the occurrence of stress risers is far likely to occur in a roll bell operating above 1800° F.

The detrimental affect of the stress riser on the roll bell is effectively offset by maintaining the operating temperature of the roll bell below the critical temperature for the alloy metal comprising the roll bell. Given that the roll bell operates at a temperature below 1800° F., the high nickel, chrome, cobalt alloy is effective. For annealing and normalizing furnaces, the critical temperature is lower, for example at 1200° F. given the use of a nickel, chrome alloy.

Figure 3:
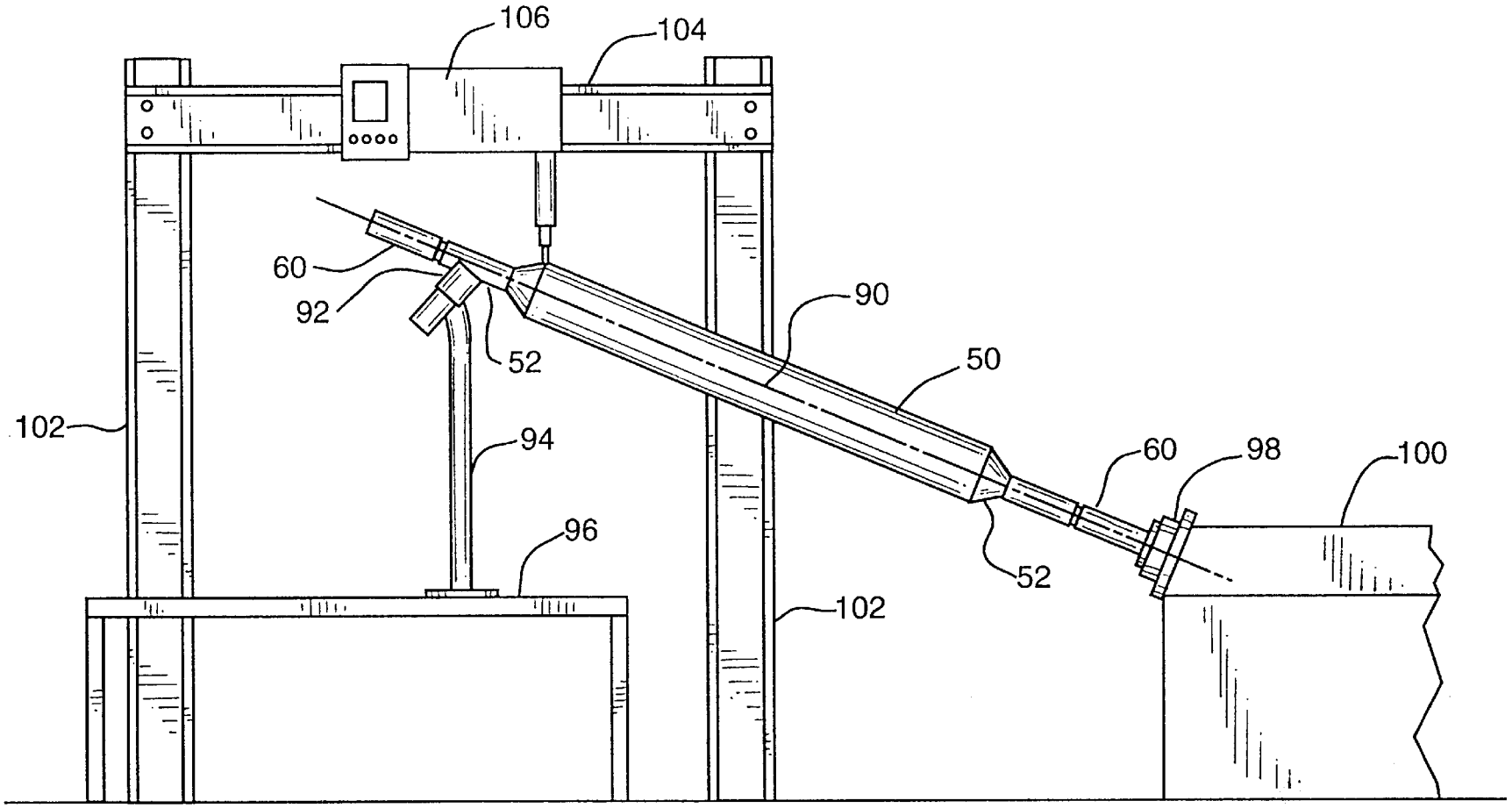
FIG. 3 is an elevational view illustrating the welding procedure for fabricating a roll assembly according to the present invention.

The formation of the weld metal adjoining the roll sleeve to the roll bell is carried out in a manner to avoid lack of fusion between the weld material and the parent metal. A lack of fusion accelerates weld failures that are known to have occurred in known dry roll constructions. It was found that in the past MIG welding was used and resulted in insufficient heat generation during the welding process to provided the required heat for the metal fusion. To overcome this shortcoming, the present invention provides the use of TIG (Tungsten Inert Gas) welding within an inert gas shield comprised of argon gas. The welding process as shown in FIG. 3 is carried out in a multi-pass layered weld formation utilizing automatic controls for voltage as well as amperage to effect a more uniform weld while transmitting less heat to the parent metal material.

It has been found that the welding speed and weld placement of the continuous weld beads is successfully achieved by arranging the roller assembly so that it rotates about the longitudinal axis 90 inclined at an angle of preferably of 45°. For this purpose as shown in FIG. 3, the roll body is fitted with the roll bells at opposite ends and the roll bell at the most elevated end is rotatably supported by a saddle bearing 92 carried by a pedestal 94 mounted on a support 96. The roll bell at the downward most end of the roll sleeve is engaged with a chuck 98 of a gear drive 100. Upstanding columns 102 are spaced apart and support a cross member 104 which inturn carries a TIG welder 106 including drives to advance the welder along the cross member 104 as well as to position the electrode 108 at the weld site. The drives for the welder and the electrodes are controlled by a microprocessor to avoid operator error to the necessary precise repositioning of the electrode after each welding pass and to assure complete fusing of the succeeding weld bead to the parent metal/existing weld metal.

By placing the roll assembly in the inclined relation to the horizontal and rotating the roll at a controlled speed, the welding process can be completely observed by an operator to assure uninterrupted weld wire feed, inert gas flow, cooling water flow, and required adjustments to the tungsten electrode position after each revolution of the roll. The microprocessor control serves further also to remove human error particularly to avoid possible electrode placement error.

Figure 4:
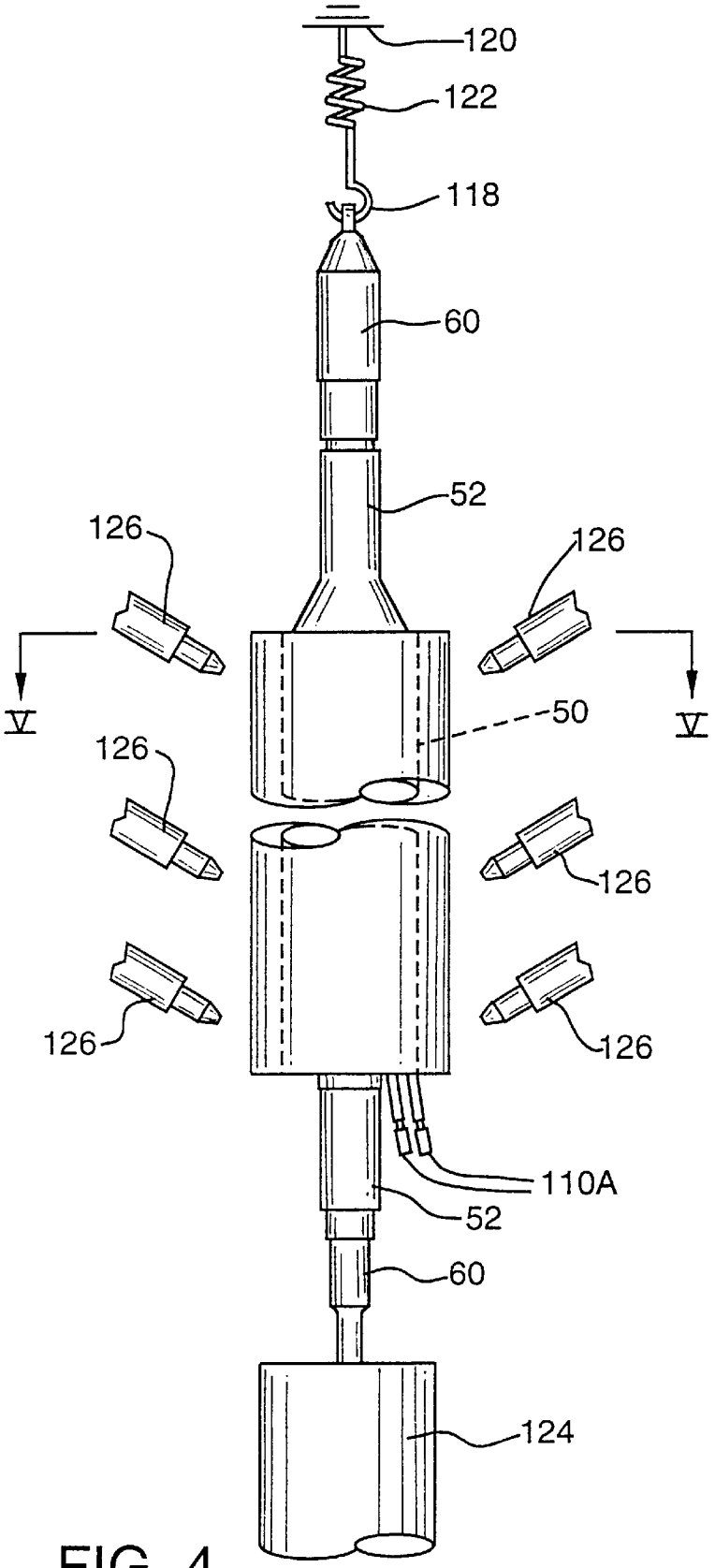
FIG. 4 is an elevational view illustrating the solution heat treating for the roll body of a dry roll according to the present invention.
Figure 5:
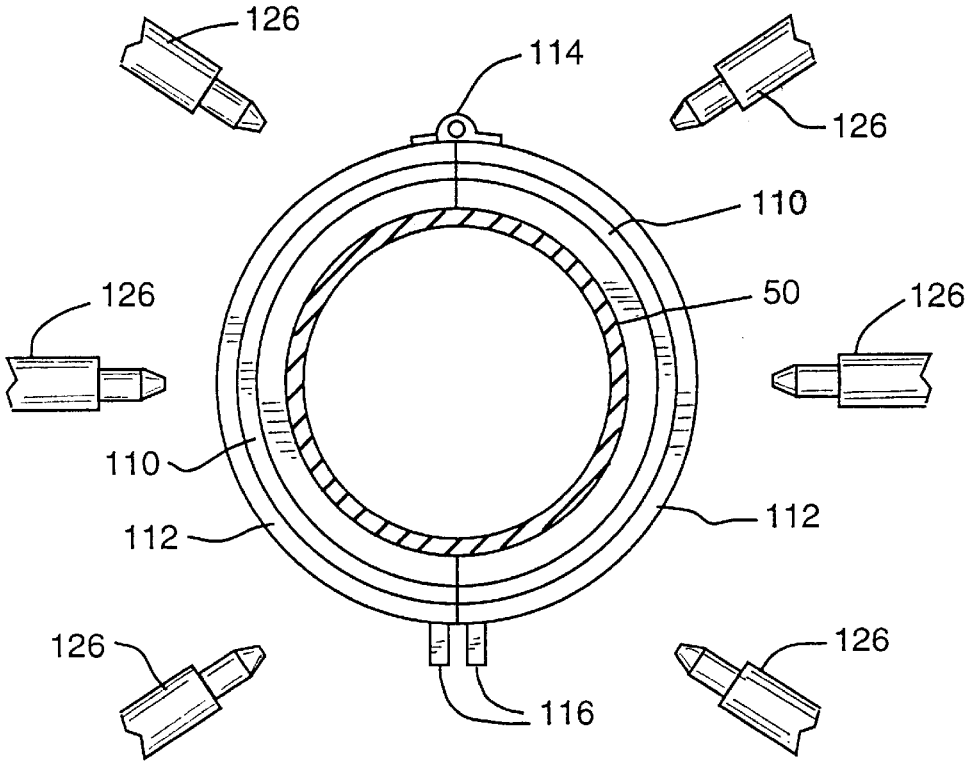
FIG. 5 is a sectional view taken along lines V—V of FIG. 4.
Figure 6:
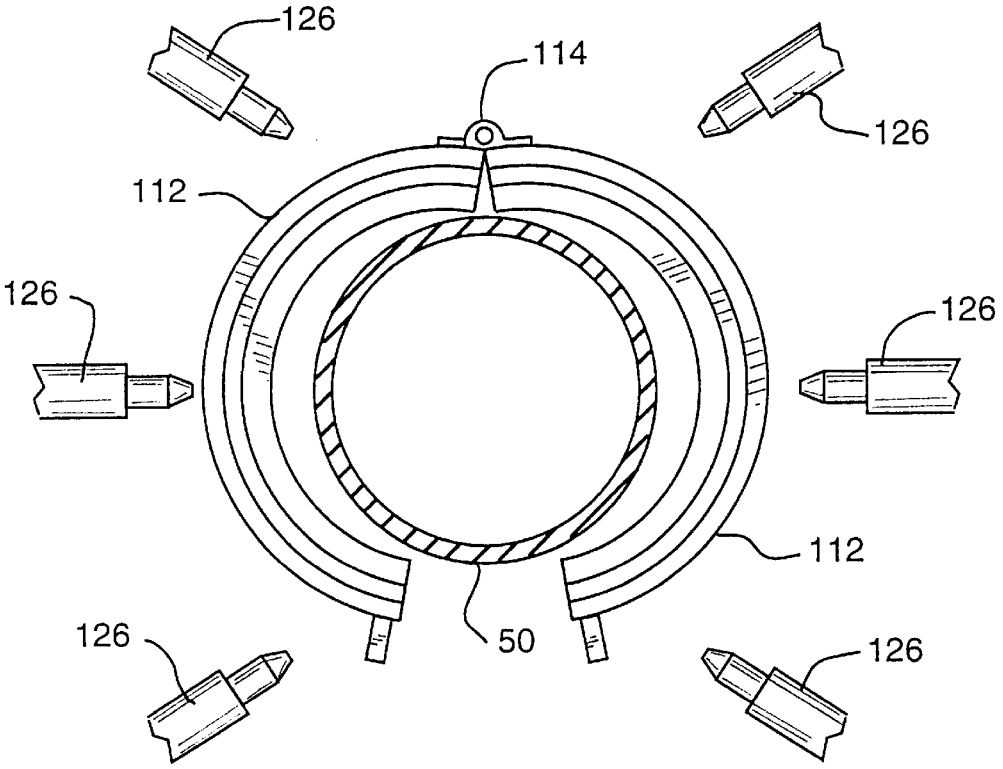
FIG. 6 is a view similar to FIG. 5 and illustrating the initial position of the solution heat treating furnace at the conclusion of the heating cycle for carrying out air quenching.

In FIGS. 4–6 there is illustrated a furnace arrangement useful to carry out solution heat treating of the roll sleeve. The heat treating process is effective with the high nickel, chrome alloys particularly where the alloy further includes cobalt. To reverse the aging process that otherwise brings about embrittlement and reduced ductility, the solution annealing returns the roll sleeve to its original metallurgy. Electrically powered heating coils 110 are mounted to the inside face of each of furnace walls 112. The walls have a configuration of a circular ring sector. The furnace walls are joined along the edge of their elongated length by hinges 114. At a site diametrically opposite to the site of hinges 114 are lugs 116 engaged by a clamp, not shown, for holding the furnace walls against pivotal movement and form a cylindrical furnace chamber wherein there is placed essentially only the roll sleeve 50.

As shown in FIG. 4, electrical cables 110A extend from the heating coils externally of the furnace chamber for connection to a suitable power supply, not shown. When power is supplied to the heating coils, the heat generated thereby heats the roll body. The roll bells while conductively heated continuously undergo air cooling by the surrounding environment and thereby avoid degregation to the weld. As the temperature of the roll body elevates the electric heaters are controlled to execute the required solution annealing cycle during which roll sleeve temperatures as high as 2200° F. will be obtained. At this high temperature, the roll body becomes plastic and will collapse from the cylindrical shape should the roll be horizontally orientated. To avoid this, the solution annealing is carried out with the roll orientated vertically but measures must be taken to relieve the roll body of the load imposed by the weight of the roll bells protruding from opposite ends of the roll body.

The roll bell protruding from the lower end of the furnace will deform the roll body at the highly heated plastic. The weight of the roll body suspended by the upper roll bell extending from the furnace is a further factor that may deform the roll sleeve. To prevent such deformation, the roll sleeve is supported in the required vertical orientation at its upper end by a hook 118 that is interconnected with the superstructure 120 which can be the cable of a crane by an intermediate load limiter such as a spring assembly 122 to limit the load carried by the superstructure to approximately the weight of the roll assembly. The free end of the roll bell protruding from the bottom of the furnace rests on a pedestal 124 to prevent loading of the roll sleeve by the weight of the lower roll bell. The solution annealing cycle is preferably programmable controlled to increase the roll temperature from ambient within selected time segments to a maximum temperature of, for example 2200° F. where it is maintained at this temperature for an extended period of time.

After soaking at the elevated temperature for the required time, the clamp holding the hinged furnace walls together is removed and the hinged furnace halves are swung about the hinged connections to expose the roll sleeve as quickly as possible so as to allow air quenching by forced air streams discharged about the periphery of the roll body by an array of nozzles 126. Preferably, the furnace housing after pivotal movement to separate the housing halves is vertically displaced to quickly expose the roll sleeve for air quenching. For this purpose the furnace may be lifted or lowered by a crane.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A heating furnace for metallic workpieces, said heating furnace including:

an elongated furnace chamber having roof supported by side walls separated by a distance for the heating of a metallic workpiece conveyed along a pass line from an entry end to a remotely spaced discharge end of said furnace chamber, said elongated side walls having aligned cavities at spaced apart intervals along the length of the heating chamber, said furnace chamber including;

heaters for maintaining a highly heated environment in the furnace chamber;

workpiece support roller assemblies traversing said distance between said side walls for supporting said metallic workpiece during heating thereof, each of said workpiece support roller assemblies including a workpiece engaging roll body having a length greater than said distance between the side walls of the furnace chamber to present terminal roll body end portions residing within the aligned cavities in said side walls, a roll bell secured by weld metal to opposite ends of said roll body said weld metal securing each roll bell to the roll body being resident within the respective cavities in said side walls by a distance sufficient to thermally isolate the weld metal from the highly heated environment in the furnace chamber, and a filling of ceramic fiber in each roll bell underlying the weld metal joining each rolled bell with the roll body for forming a thermal barrier against radiant heating of the weld metal from within said roll body, said ceramic fiber in each roll bell and the thermal isolation of said weld metal from the furnace chamber by the resident sites in the furnace walls preventing embrittlement of the weld metal by thermally induced aging;

bearing means externally of said furnace chamber for rotatably supporting said roller assembly; and drive means for rotating said workpiece support roll assemblies to advance the workpiece engaged with said roll body along said furnace chamber.

2. The heating furnace according to claim 1 further including a disk at the end of each roll bell for preventing dislodgment of said filling of ceramic fiber.

3. The heating furnace according to claim 1 further including a stub shaft secured to the end of each roll bell external of said furnace for engaging said bearing means to rotatably support the workpiece roller assemblies.

4. The heating furnace according to claim 3 wherein said ceramic fiber fills the roll shell substantially commencing at a terminal end of the roll shell and extending substantially to said stub shaft for forming the terminal barrier to maintain a reduced operating temperature of the stub shaft to such an extent that to avoid a loss of induction hardness of anti-friction bearing raceways and roller means comprising said bearing means.

5. The heating furnace according to claim 1 wherein said roll body is comprised of a hollow tube and wherein said roll bell includes an end portion to fit within the hollow of roll body and wherein said weld metal extends from terminal end face of said roll shell to the external surface of said roll bell.

6. The heating furnace according to claim 1 wherein said roll body and said roll bell secured to opposite ends of the roll body are comprised of high nickel chrome cobalt alloy to allow solution annealing for preventing roll fracturing due to an increasing creep strength and decrease in ductility.

7. The heating furnace according to claim 6 wherein at least one of said aligned cavities in said side walls is defined by a diameter sufficiently greater than the outside diameter of said roll body to allow an operating clearance for rotation of a terminal roll body end portion of said roll body and removal of a workpiece support roller assembly from the furnace chamber, said heating furnace further including means for solution annealing the body portion of a workpiece roller assembly after a predetermined time of exposure to an operating temperature in said furnace chamber.

8. The heating furnace according to claim 1 wherein said weld metal consists of tungsten inert gas welding and multi-pass weld beads.

9. A method to heat metallic workpieces, said method including the steps of:

selecting a plurality of workpiece support roller assemblies each of which essentially includes a workpiece engaging roll body secured to a roll bell at each of opposite ends by weld metal; providing a filling of ceramic fiber underlying the weld metal joining each roll bell with a roll body;

arranging said workpiece support roller assemblies at spaced apart intervals along a pass line to extend between elongated side walls having a roof supported thereby to form a furnace chamber, said side walls having aligned cavities dimensioned sufficiently to receive terminal end portions of said roll body to thermally isolate the weld metal from a high temperature environment in said furnace chamber;

supporting each of said plurality workpiece support roller assemblies for rotation about an axis extending along the length of each of the roller assemblies; and rotating each of the plurality of workpiece support assemblies to advance a workpiece along the length of the elongated heating chamber.

10. The method according to claim 9 wherein said step of selecting workpiece support roller assemblies includes selecting roll bodies comprised of hollow tubular members produced by spin casting high nickel, chrome cobalt alloy steel.

11. The method according to claim 9 wherein said step of selecting workpiece support roller assemblies includes selecting roll bells comprised of hollow castings produced statically from high nickel, chrome, cobalt alloy steel.

12. The method according to claim 11 wherein the selected roll bells each include a truncated conical portion to reside within one of the aligned cavities in the side walls of the furnace chamber, the method including the further step of providing a stub shaft in a reduced diameter portion of the truncated conical portion for rotational support of the roller assembly by bearing spaced remotely outwardly of the side walls of the furnace chamber.

13. The method according to claim 9 wherein said step of selecting workpiece support roller assemblies includes supporting the roll bells at opposite ends of a roll body for rotation about a longitudinal axis inclined to the horizontal, tungsten inert gas welding the end faces of the roll body to the roll bells by juxtapositioned weld beads formed while rotating the roll body and roll bells about said longitudinal axis.

14. The method according to claim 9 including the further step of removing a workpiece support roller assembly from said furnace chamber after a predetermined time interval of operation at the elevated temperature of the furnace chamber, arranging such a roller assembly after removal from the furnace chamber such that the rotational axis is substantially vertical, surrounding the roll body in a heating furnace, controlling said heating furnace according to a solution annealing cycle, to increase ductility and reduce embrittlement of the metal comprising the roll body.

15. The method according to claim 14 wherein said step of arranging such a roller assembly to orientate the rotational axis substantially vertical includes applying a resilient vertically directed force to one end portion of the roller assembly and blocking the other end of the roller assembly to prevent elongation of the roll body during such solution annealing cycle.

16. The method according to claim 15 wherein said one end portion comprises the upper end portion of the roller assembly.

17. The method according to claim 14 including the further step of directing streams of air to impart forced air cooling upon completion of said solution annealing process.

18. In a heating furnace for metallic workpieces, a workpiece roller assembly including:

a workpiece engaging roll body having a body length greater than the distance between the side walls for such a heating furnace to present terminal roll body end portions residing within the aligned cavities in the furnace side walls;

a roll bell secured to each of opposite ends of said roll body by beads of weld metal, said weld metal beads being juxtaposition by multi-pass tungsten inert welding with the roll body rotating inclined to the horizontal about the central axis thereof, said weld metal securing each roll bell to the roll body being spaced apart by the body length of said roll body to reside within cavities in such side walls by a distance sufficient to thermally isolate the weld metal from the highly heated environment in the furnace chamber; and a filling of ceramic fiber in each roll bell underlying said weld metal joining for forming a thermal barrier against radiant heating of the weld metal from within said roll body, said ceramic fiber in each roll bell and the thermal isolation of said weld metal from the furnace chamber by the resident sites in the furnace walls preventing embrittlement of the weld metal by thermally induced aging.

* * * * *